United States Patent [19]

Tashiro

[11] Patent Number: 4,627,392

[45] Date of Patent: Dec. 9, 1986

[54] CERAMIC TIP CAST IN VALVE ROCKER ARM

[75] Inventor: Keisuke Tashiro, Kyoto, Japan

[73] Assignees: Mitsubishi Jidosha Kogyo Kabushiki Kaisha; NGK Insulators, Ltd., both of Japan

[21] Appl. No.: 724,061

[22] Filed: Apr. 17, 1985

[30] Foreign Application Priority Data

Apr. 18, 1984 [JP] Japan ..... 59-55892

[51] Int. Cl.[4] ..... F01L 1/18

[52] U.S. Cl. ..... 123/90.39

[58] Field of Search ..... 123/90.39

[56] References Cited

U.S. PATENT DOCUMENTS 4,147,074 4/1979 Nouguchi et al. ..... 123/90.39

FOREIGN PATENT DOCUMENTS

| | | | |
|---|---|---|---|
| 2146951 | 3/1973 | Fed. Rep. of Germany | 123/90.39 |
| 2163529 | 7/1973 | Fed. Rep. of Germany | 123/90.39 |
| 66606 | 5/1980 | Japan | 123/90.39 |
| 87809 | 7/1980 | Japan | 123/90.39 |
| 97007 | 6/1982 | Japan | 123/90.39 |
| 13113 | 1/1983 | Japan | 123/90.39 |

*Primary Examiner*—Ira S. Lazarus

*Attorney, Agent, or Firm*—Abelman Frayne Rezac & Schwab

[57] ABSTRACT

In a ceramic tip comprising a slipper block engaged by a cam arranged for rotation for causing opening and closing movement of an inlet valve on an exhaust valve of an engine, and a cast body block cast integrally with a valve rocker arm body, a round slope is formed at the conjoined boundary area between the slipper block and the cast body block to prevent occurrence of cracks, and retaining channels are formed on the cast body block to prevent escapement of the cast body block from the valve rocker arm body.

6 Claims, 4 Drawing Figures

FIG. 1
PRIOR ART
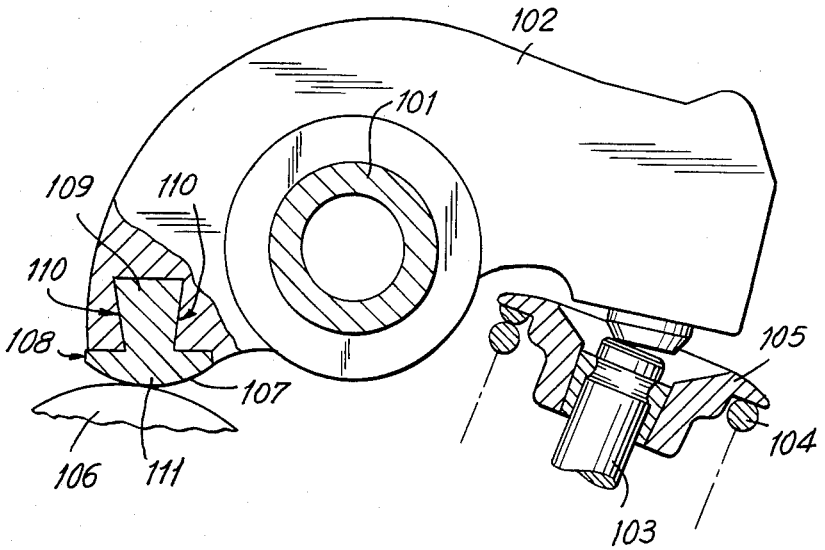
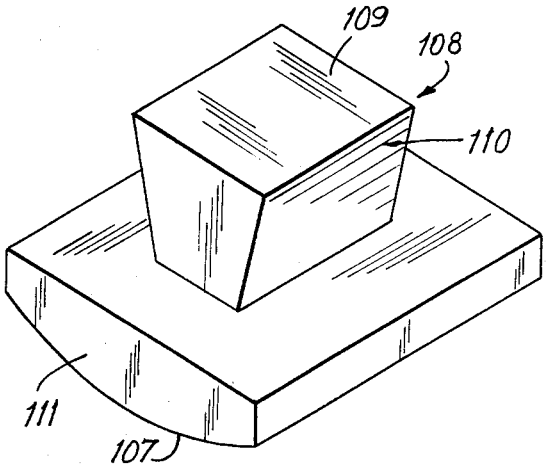
FIG. 2
PRIOR ART

FIG. 3
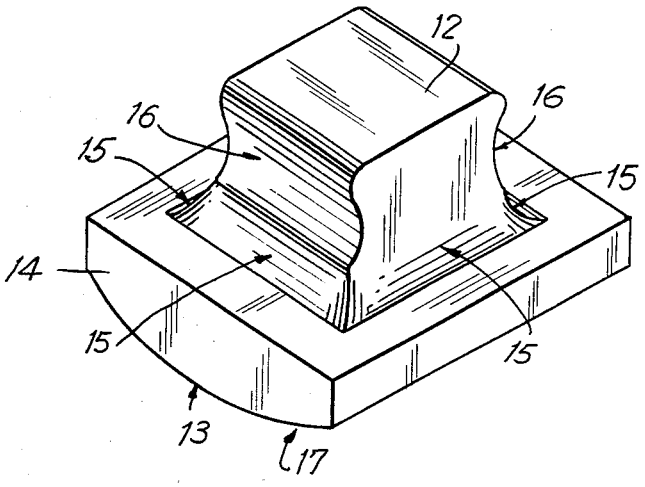
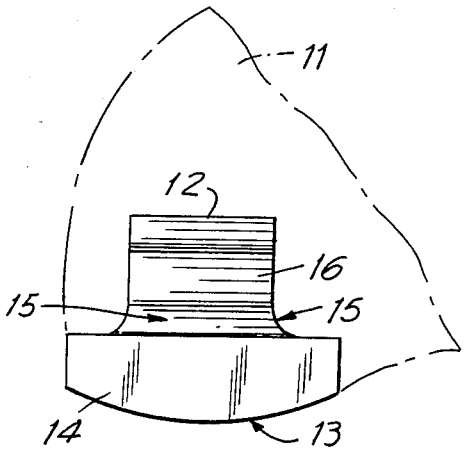
FIG. 4

CERAMIC TIP CAST IN VALVE ROCKER ARM

FIELD OF THE INVENTION

This invention relates to a ceramic tip cast integrally with the body of a valve rocker arm for improving the reliability of the valve rocker arm from the aspect of mechanical strength.

BACKGROUND OF THE INVENTION

In vehicles, especially, those equipped with diesel engines, an exhaust gas recirculation system is most frequently incorporated for recirculation of a portion of engine exhaust gases as a part of new charge therely minimizing the amount of oxides of nitrogen contained in the exhaust gases. However, when such an exhaust gas recirculation system is used, solid carbon contained in the exhaust gases is also mixed into intake air, and the carbon tends to be contained in the engine oil. There has therefore been the tendency that articles of carbon flow into the area between, for example, cams arranged for rotation for causing opening and closing movement of inlet valves and exhaust valves of the engine and slipper faces of valve rocker arms swung by the cams, resulting in unusual abrasion of the slipper faces having a hardness lower than that of the surface of the cams.

To avoid such a trouble, formation of this slipper portion from a ceramic material this kind of silicon nitride is disclosed in, for example, Japanese Patent Laid Open No. 217307/1984. The structure disclosed in the cited patent application is shown in FIG. 1. Referring to FIG. 1, a valve rocker arm body 102 is rotatably or rockably mounted on a rocker arm shaft 101. One end of the valve rocker arm body 102 is engaged by the upper end of a valve stem 103 of an inlet valve or an exhaust valve in an engine. The valve stem 103 is normally biased upward by the force of a valve spring 104 through a spring retainer 105. A cam 106 driven from the engine engages the other or base end of the valve rocker arm body 102 for causing rocking movement of the valve rocker arm body 102 around the shaft 101. A ceramic tip 108 having a slipper face 107 actually engaged by the cam 106 is provided integrally with the base end of the valve rocker arm body 102. Generally, this ceramic tip 108 is cast integrally in the base end of the valve rocker arm body 102 during casting of the valve rocker arm body 102.

As shown in FIG. 2 which is an enlarged perspective external view of the prior art ceramic tip 108, a pair of wedge-like tapered retaining faces 110 are formed on a cast body block 109 of the ceramic tip 108 for preventing escapement of the ceramic tip 108 from the valve rocker arm body 102. However, when, in the ceramic tip 108 having such a structure, an impulsive force generated due to the rotation of the cam 106 is repeatedly imparted, as moment of rotation, to a slipper block 111 having the slipper face 107, cracks tend to occur at the constricted basal part of the cast body block 109. Thus, the prior art ceramic tip has been shown to be defective in that the possibility of damage due to generation of cracks is very large resulting in a very low reliability.

SUMMARY OF THE INVENTION

With a view to obviate such a prior art defect, it is a primary object of the present invention to provide a ceramic tip cast in a valve rocker arm, which can exhibit a mechanical strength sufficient to withstand the impact imparted due to the rotation of the cam and which is therefore highly reliable.

In accordance with the present invention which attains the above object, there is provided a ceramic tip cast in a valve rocker arm, comprising a slipper block having a part-cylindrical slipper face engaged by a cam arranged for rotation for causing opening and closing movement of an inlet valve or an exhaust valve of an engine, and a cast body block protruding from reverse side of the slipper face of the slipper block and cast integrally with the valve rocker arm body, wherein a round slope is formed at the conjoined boundary area between the slipper block and the cast body block to alleviate stress concentration on the conjoined boundary area, and a pair of retaining channels are formed on the cast body block to extend in an orthogonal direction with respect to a rocker arm shaft for preventing escapement of the cast body block from the valve rocker arm body.

BRIEF DESCRIPTION OF THE DRAWINGS

FIG. 1 is a partly sectional, elevation view showing schematically the structure of parts including a valve rocker arm to which the present invention is directed.

FIG. 2 is an enlarged, perspective external view of the prior art ceramic tip cast in the valve rocker arm body shown in FIG. 1.

FIG. 3 is a perspective external view of a preferred embodiment of the ceramic tip according to the present invention.

FIG. 4 is a schematic, side elevation view of the ceramic tip of the present invention when incorporated in a valve rocker arm.

DETAILED DESCRIPTION OF PREFERRED EMBODIMENTS

A preferred embodiment of the ceramic tip according to the present invention will be described in detail with reference to FIG. 3, which is a perspective external view thereof, and FIG. 4, which shows the state of the ceramic tip cast in a valve rocker arm body.

Referring to FIGS. 3 and 4, the ceramic tip embodying the present invention is generally designated by the numeral 17 and comprises a cast body block 12 cast in a valve rocker arm body 11. The cast body block 12 is formed integrally with a slipper block 14 having a part-cylindrical slipper face 13 and protrudes from the face of the slipper block 14 remote from the slipper face 13, At the conjoined boundary area between the cast body block 12 and the slipper block 14, where the cast body block 12 is joined to the slipper block 14, a round slope 15 having a radius of curvature of more than 1.0 mm (for example, 1.5 mm) is formed to continuously extend along the conjoined boundary area so as to prevent stress concentration on the conjoined boundary area. Further, in order to prevent escapement of the cast body block 12 from the valve rocker arm body 11, a pair of retaining channels 16 having an arcuate sectional shape are formed on the cast body block 12 to extend in parallel to each other in a direction orthogonal with respect to a rocker arm shaft (not shown). The material of the ceramic tip 17 according to the present invention is preferably a fine ceramic material having a high hardness and a high resistance to heat, such as, silicon nitride, silicon carbide or boron nitride.

Therefore, even when bending moment due to rotation of a cam (not shown) may be imparted to the ceramic tip 17 in the circumferential direction of the slipper face 13, the ceramic tip 17 can sufficiently withstand the impact and there is substantially no possibility of generation of cracks, since the cast body block 12 has not any constriction in the direction of impartation of the bending moment, as seen in FIG. 4. The round slope 15 and retaining channels 16 may be formed after calcination. In such a case, the step of grinding can be simplified. Further, the ceramic tip 17 may be integrated with the valve rocker arm body 11 by any one of a such as die casting molding and so on. When, for example, die casting is utilized, the valve rocker arm body 11 is cast in a state in which the ceramic tip 17 is previously mounted in a predetermined position in a die casting mold. In this case, later finishing of the slipper face 13 is unnecessary. Further, although the slipper block 14 and the cast body block 12 of the ceramic tip 17 embodying the present invention are rectangular in shape, they may be columnar in shape. In such a case, it is preferable that the retaining channels 16 extend along the entire periphery of the cast body block 12.

It will be understood from the foregoing detailed description that, in the ceramic tip according to the present invention, a slope for allevating stress concentration is formed at the conjointed boundary area between the slipper block and the cast body block, and a pair of retaining channels for preventing escapement of the ceramic tip from the valve rocker arm body are formed to extend in a direction orthogonal with respect to the rocker arm shaft, so that there is no change in the width of the cast body block along the direction of impartation of bending moment to the ceramic tip. Therefore, the resistance of the ceramic tip according to the present invention against an impact is greatly improved over that of the prior art one, and the ceramic tip of the present invention which eliminates substantially the possibility of generation of cracks due to the impartation of impact has a high reliability in use.

I claim:

1. In a cast ceramic tip for a rocker arm of an automotive engine, a slipper block having a contoured cam engaging surface extending longitudinally of one face thereof, and having a retainer block formed integrally with said slipper block and extending substantially perpendicular to an opposite face of said slipper block, said retainer block having opposite longitudinally extending faces and opposite laterally extending faces, the improvement comprising:

radiused fillets extending laterally of said opposite faces of said slipper block, and providing transitions between said opposite face thereof and said opposite laterally extending faces of said retainer block; and, retaining channels formed exclusively in said longitudinally extending faces of said retainer block, said laterally extending faces being substantially planar.

2. The cast ceramic tip according to claim 1, including radiused fillets extending longitudinally of said opposite face of said slipper block, and providing transitions between said opposite face thereof and said opposite longitudinally extending faces of said retainer block.

3. The cast ceramic tip according to claim 2, in which said radius of each of said laterally and longitudinally extending fillets is in excess of 1.0 mm.

4. The cast ceramic tip according to claim 1, in which said radius of said fillets is in excess of 1.0 mm.

5. The cast ceramic tip according to claim 1, in which each of said longitudinally extending channels is radiused.

6. The cast ceramic tip according to claim 1, in which said ceramic tip is formed from silicone nitride.

* * * * *